US011697436B2

(12) United States Patent
Valayer et al.

(10) Patent No.: US 11,697,436 B2
(45) Date of Patent: Jul. 11, 2023

(54) DEVICE FOR SUPPORTING AND GUIDING A HAULING CABLE OF A VEHICLE TRANSPORTATION INSTALLATION AND METHOD FOR CHECKING SUCH A DEVICE

(71) Applicant: POMA, Voreppe (FR)

(72) Inventors: Sylvain Valayer, Charavines (FR); Salah Messaoud, Brézins (FR)

(73) Assignee: POMA, Voreppe (FR)

( * ) Notice: Subject to any disclaimer, the term of this patent is extended or adjusted under 35 U.S.C. 154(b) by 416 days.

(21) Appl. No.: 16/769,955

(22) PCT Filed: Dec. 4, 2018

(86) PCT No.: PCT/FR2018/053108
§ 371 (c)(1),
(2) Date: Jun. 4, 2020

(87) PCT Pub. No.: WO2019/110921
PCT Pub. Date: Jun. 13, 2019

(65) Prior Publication Data

US 2020/0385027 A1 Dec. 10, 2020

(30) Foreign Application Priority Data

Dec. 4, 2017 (FR) ..... 1761591

(51) Int. Cl.
*B61B 12/02* (2006.01)

(52) U.S. Cl.
CPC ..... *B61B 12/02* (2013.01)

(58) Field of Classification Search
CPC ..... B61B 12/02; B61B 7/00; B61B 11/00; B61B 11/002; B61B 12/06; E05D 5/10; E05D 5/12; E05D 5/121; E05D 5/125; E05D 5/127; E05D 5/128; E05D 5/14; E05D 2005/102; E05D 2005/122; E05D 2005/124; Y10T 16/557; Y10T 16/5373
USPC ..... 16/386, 274, 2.1, 2.2, 2.3, 2.4, 2.5; 104/11, 113, 115, 117, 173.1, 194, 197
See application file for complete search history.

(56) References Cited

U.S. PATENT DOCUMENTS 2,608,161 A * 8/1952 Wallmannsberger ... B61B 12/12 104/216
4,220,095 A 9/1980 Segafredo
4,777,886 A * 10/1988 Tarassoff ..... B61B 12/02 104/180

(Continued)

FOREIGN PATENT DOCUMENTS

CH 620 644 A5 12/1980
DE 2816941 A * 11/1978 ..... B61B 12/06

(Continued)

OTHER PUBLICATIONS

Mar. 27, 2019 Search Report issued in International Patent Application No. PCT/FR2018/053108.

*Primary Examiner* — Kimberly T Wood
(74) *Attorney, Agent, or Firm* — Oliff PLC

(57) ABSTRACT

A device for supporting and guiding a hauling cable of a vehicle transportation installation, including a support structure, at least one movable member and at least one axis enabling the at least one movable member to swivel with respect to the support structure, an opening being formed inside the at least one axis and extending between two ends of the at least one axis.

7 Claims, 2 Drawing Sheets

(56) References Cited

U.S. PATENT DOCUMENTS

2009/0057632 A1 3/2009 Bonifat et al.

FOREIGN PATENT DOCUMENTS

| | | | | | |
|---|---|---|---|---|---|
| EP | 0 790 167 | A1 | | 8/1997 | |
| EP | 0790167 | A1 | * | 8/1997 | |
| FR | 2391450 | A | * | 1/1979 | ..... B61B 12/06 |
| FR | 2 838 697 | A1 | | 10/2003 | |
| FR | 2 920 385 | A1 | | 3/2009 | |
| WO | 2017/187415 | A2 | | 11/2017 | |

* cited by examiner

DEVICE FOR SUPPORTING AND GUIDING A HAULING CABLE OF A VEHICLE TRANSPORTATION INSTALLATION AND METHOD FOR CHECKING SUCH A DEVICE

BACKGROUND OF THE INVENTION

The invention relates to support and guiding of a hauling cable of a vehicle transportation installation, and more particularly to support and guiding of an aerial hauling cable.

STATE OF THE ART

At the present time, transportation installations by hauling cable are equipped with support and guiding devices such as sheave assemblies to support and guide the hauling cables in movement between the passenger loading and unloading terminals. Generally speaking, the sheave assemblies are supported by towers and are equipped with rotating sheaves on which the hauling cable presses. The sheaves are mounted rotating on articulated beams to keep the hauling cable pressing on the tower when variations of the cable bow occur due to the weight of the vehicle and to its clamp running over the sheaves.

French Patent application FR2920385 filed in the name of the applicant can be cited disclosing a mechanical adjustment device of a support and guiding sheave assembly of an aerial cable of a mechanical lift installation. The sheave assembly comprises cable guide sheaves mounted rotating on a support frame according to parallel axes of rotation staggered along the support frame. The support frame is fixed to a brace of a tower and the mechanical device further comprises means for adjusting the inclination of the brace so that the sheaves of the sheave assembly are perfectly vertical.

Swiss Patent application CH620644 can also be cited which discloses a sheave assembly comprising a swivel axis. French Patent application FR2838697 discloses a sheave assembly, comprising a frame formed by two flanges connected by a hub and a shaft opening into the hub to enable the frame to rotate with respect to a tower. European Patent application EP0790167 discloses a sheave assembly supporting an aerial cable, comprising a member that is movable with respect to an auxiliary member constituted of two flanges. The sheave assembly is equipped with a composite bearing allowing the movable member to swivel with respect to the auxiliary member, the composite bearing comprising a bolt passing through the flanges and a sleeve placed between the two flanges.

Sheave assemblies are complex assemblies that regularly have to be inspected to check their condition. In particular, it may be necessary to dismantle a sheave assembly to perform a precise inspection of the parts which may be worn and have to be replaced, in particular the swivel axes. Dismantling a sheave assembly is a long and delicate operation.

OBJECT OF THE INVENTION

One object of the invention consists in remedying these shortcomings, and more particularly in providing means for inspecting the parts composing a sheave assembly easily without having to completely dismantle the sheave assembly.

According to one feature of the invention, a device for supporting and guiding a hauling cable of a vehicle transportation installation is proposed, comprising a support structure, at least one movable member, and at least one axis enabling said at least one movable member to swivel with respect to the support structure.

An opening is formed inside said at least one axis and extends between two ends of said at least one axis.

It is thus possible to inspect the inside of the axes of the device for supporting and guiding by means of a measuring device or simply by visual inspection by a maintenance operator without having to dismantle the device for supporting and guiding. Inspection can in addition take place during normal use of the device.

The device for supporting and guiding can comprise a first movable member, a second movable member, and an axis mounted fixed on the first movable member and enabling the second movable member to swivel with respect to the support structure and to the first movable member, the first movable member comprising two lateral flanges forming an inner space for the second movable member to pass through, the two ends of the axis being located respectively salient from the two lateral flanges and outside the inner space, and an opening is formed inside the axis and extends between the two ends of the axis.

The opening can be a through opening.

The device can comprise at least one stop located facing the opening and configured to limit a translation of said at least one axis, a through hole being formed inside said at least one stop.

At least one stop can be mounted in a removable manner on said at least one axis of the device.

The device can comprise two stops respectively located at the ends of said at least one axis, the stops being configured to limit a translation of said at least one axis.

A through hole can be formed inside at least one stop, the device comprising a fixing means mechanically connecting the two stops to one another and extending inside the through opening.

According to another feature of the invention, a method for checking a device for supporting and guiding a hauling cable of a vehicle transportation installation is proposed.

The method comprises providing the device comprising a support structure, at least one movable member and at least one axis enabling said at least one movable member to swivel with respect to the support structure, an opening being formed inside said at least one axis and extending between two ends of said at least one axis, and checking an inner wall of said at least one axis delimiting the opening.

The method can comprise forming a through opening inside said at least one axis.

The method can comprise mounting at least one stop in a removable manner on said at least one axis of the device, then disassembling said at least one stop before checking the inner wall.

The method can further comprise fixing two stops at the ends of said at least one axis by means of a fixing means extending inside the through opening.

BRIEF DESCRIPTION OF THE DRAWINGS

Other advantages and features will become more clearly apparent from the following description of particular embodiments and implementation modes of the invention given for non-restrictive example purposes only and represented in the appended drawings, in which.

DETAILED DESCRIPTION

Figure 1:
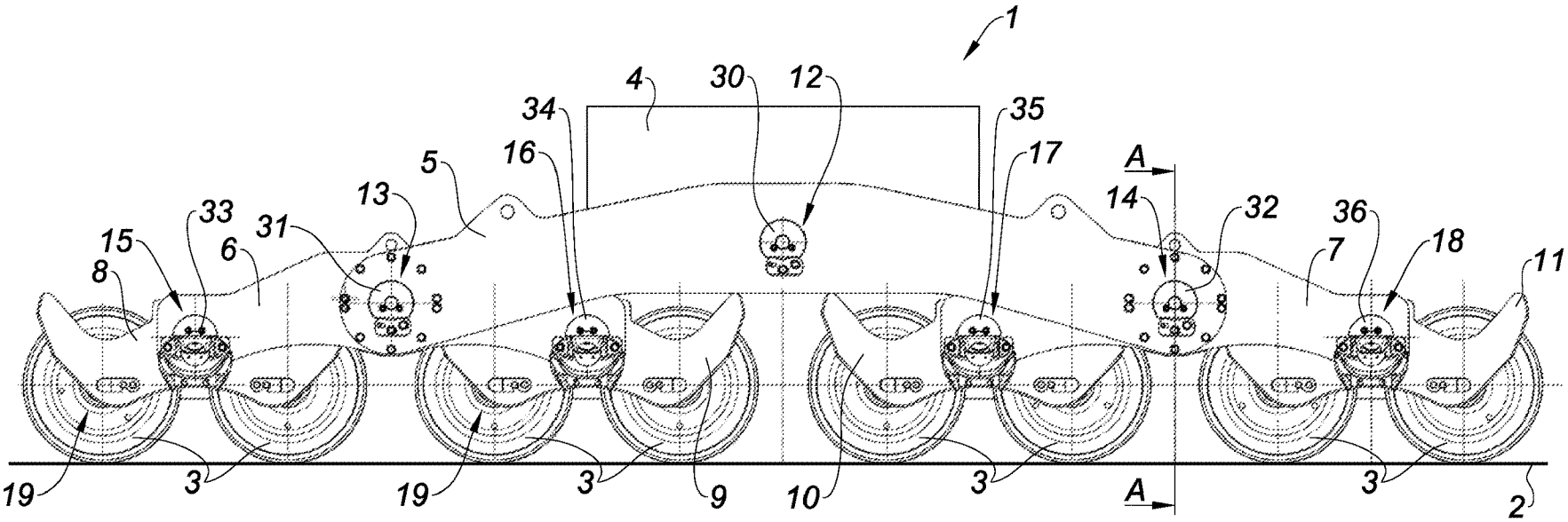
FIG. 1 schematically illustrates a perspective side view of an embodiment of a device for supporting and guiding according to the invention.
Figure 2:
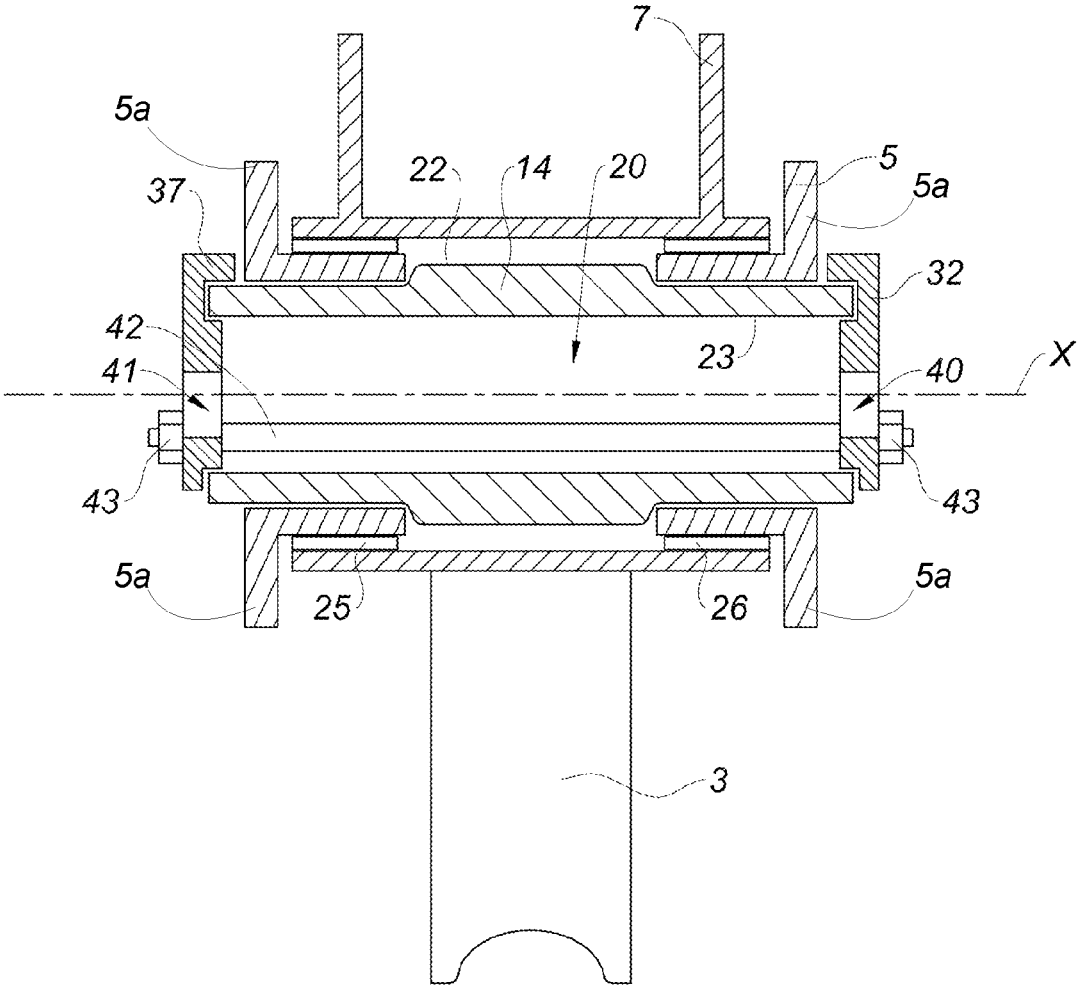
FIG. 2 schematically illustrates a cross-sectional view along the line A-A of FIG. 1.

In FIGS. 1 and 2, a device 1 for supporting and guiding has been represented. The device 1 for supporting and guiding, also called sheave assembly, provides support and guiding for a moving hauling cable 2 of a vehicle transportation installation. The vehicle transportation installation by hauling cable 2 is preferably of aerial cable car type, such as a chair lift or a gondola lift, and hauling cable 2 is an aerial cable. The installation can be of funicular railway type and hauling cable 2 is then located at ground level. The vehicles transporting people are attached to hauling cable 2 to be hauled from one terminal of the installation to the other. In particular, sheave assembly 1 is a mobile structure supporting rotating sheaves 3 designed to be in contact with hauling cable 2. Sheave assemblies 1 are generally mounted movable on the top of a tower, not shown here for the sake of simplification.

A sheave assembly 1 comprises a support structure 4, at least one movable member 5 to 11 and at least one axis 12 to 19. Support structure 4 is mounted fixed on the tower. A movable member 5 to 11, also called beam, enables sheaves 3 to swivel with respect to support structure 4 in order to follow the movements of hauling cable 2. Axes 12 to 19 enable movable members 5 to 11 to perform this swivelling. For example, a sheave assembly 1 comprising eight rotating sheaves 3 has been represented in FIG. 1. Sheave assembly 1 comprises a main member 5 mounted movable on support structure 4, by means of a main axis 12. Two secondary movable members 6, 7 are mounted movable on main member 5 by means of respective secondary axes 13, 14. Two tertiary members 8, 9 are mounted movable on a first secondary member 6 by means of two tertiary axes 15, 16. Two other tertiary members 10, 11 are mounted movable on a second secondary member 7 by means of two tertiary axes 17, 18.

Each sheave 3 is mounted rotating on a tertiary member 8 to 11 by means of an axis of rotation 19. In general manner, a first member is mounted articulated on a second member by means of an axis. Axes 12 to 19 are mounted fixed on a first member and enable a second member to swivel with respect to the first member. More particularly, sheaves 3 are mounted rotating and movable members 5 to 11 are mounted swivelling. What is meant by "mounted rotating" is a member being able to perform one or several rotations around an axis. What is meant by "mounted swivelling" is a member able to perform a partial rotation of less than 360° in one direction of rotation or the other. The swivelling movement of each movable member 5 to 11 depends on the load exerted by hauling cable 2.

An axis 12 to 19 is an elongate part serving the purpose of articulating a movable member, in rotation or swivelling, with respect to an object on which the axis is mounted fixed, the object being able to be fixed or movable. A movable member 5 to 11 is articulated around an axis of rotation or a pivoting axis that coincides with the longitudinal axis of symmetry of the part. A beam 5 to 11 has for example a U-shaped cross-section and comprises two lateral flanges 5*a* forming a space for movable members 5 to 11 to pass through. More particularly, an opening 20 is formed inside an axis 12 to 19. Opening 20 extends between two ends of an axis 12 to 19. An axis 12 to 19 further has a body extending in a longitudinal direction X. Opening 20 can the blind, i.e. it extends partially inside the body of an axis 12 to 19, between the ends of axis 12 to 19. In this case, opening 20 opens out at one end of axis 12 to 19. As a variant, two openings can be formed inside the body of an axis 12 to 19, i.e. each opening is blind. In this case, the two openings respectively open out at the two ends of axis 12 to 19, the openings being separated by a wall of the body of axis 12 to 19. Opening 20 is preferably a through opening as illustrated in FIG. 2. In this case, opening 20 extends over the whole length of the body of axis 12 to 19 and opens out at the two ends of axis 12 to 19. The body of axis 12 to 19 comprises an outer surface 22 and an inner surface 23. Inner surface 23 delimits opening 20. In general manner, an opening formed inside the body of an axis 12 to 19 provides access for inspection of inner surface 23 of the body of axis 12 to 19. Preferably, when opening 20 is a through opening, it enables elements to be passed through from one side of device 1 for supporting and guiding to the other, while at the same time protecting them. For example, such elements can be electric cables. In particular, a secondary axis 14 mounted fixed on main member 5 and enabling second secondary member 7 to swivel has been represented in FIG. 2.

Preferentially sheave assembly 1 comprises at least one bearing 25, 26 to allow relatives sliding of a movable member 5 to 11 with respect to support structure 4. Bearings 25, 26 are located between an axis 12 to 19 and a movable member 5 to 11. In particular, movable members 5 to 11 swivel by means of smooth bearings 25, 26. A smooth bearing 25, 26 can be a hollow cylindrical part. Sheaves 3 are for their part preferably mounted rotating by means of rolling bearings such as roller bearings or ball-bearings.

Advantageously, device 1 for supporting and guiding comprises at least one stop 30 to 37. Preferentially device 1 comprises one pair of stops per axis 12 to 19. A stop 30 to 37 is a part designed to limit translation of an axis 12 to 19 in its longitudinal direction X. A stop 30 to 37 prevents an axis 12 to 19 from coming out from sheave assembly 1. A stop 30 to 37 is placed at one end of an axis 12 to 19. In particular, a stop 30 to 37 is located facing an opening 20 of axis 12 to 19. Furthermore, a through hole 40, 41 can be formed inside a stop 30 to 37. Through holes 40, 41 enable inspection of the inner surface 23 of an axis 12 to 19 by means of an apparatus having a detection means able to pass through these through holes 40, 41. For example, such an apparatus can comprise a flexible, optic or electric cable or a cable able to conduct ultrasounds. In particular, through holes 40, 41 can also allow elements to pass through to the inside of opening 20 of an axis 12 to 19. In FIG. 2, a pair of stops 32, 37 has been represented located respectively at the two ends of axis 14. Preferentially, two through holes 40, 41 are formed respectively inside the two stops 32, 37. The quantity of light entering axis 12 to 19 is thereby increased making inspection of its inner wall 23 easier to perform. Stops 30 to 37 can be mounted fixed on a movable member 5 to 19 or on support structure 4. As a variant and as illustrated in FIG. 2, two stops 32, 37 are respectively situated at the ends of axis 14 and sheave assembly 1 comprises a fixing means 42 connecting the two stops 32, 37 mechanically to one another. A simple fixing means is thereby provided that does not require specific housings to be provided on a movable member 5, or support structure 4, in order to receive the fixing means of stops 30 to 37. Fixing means 42 extends inside through opening 20. Fixing means 42 can be a rod fixed to stops 32, 37 by means of nuts 43. Stops 30 to 37 can be mounted removable so as to be able to extract an axis 12 to 19 from sheave assembly 1 to replace it.

As illustrated in FIG. 2, main member 5 comprises two lateral flanges 5*a* forming a space, called inner space, for movable secondary member 7 to pass through. Each flange comprises a shoulder directed towards the inner space. The shoulder of a flange delimits a hole. Secondary axis 14 passes through the holes of the two lateral flanges 5*a*. Secondary axis 14 is mounted fixed on main member 5. In particular, secondary axis 14 is mounted fixed on the shoulders of the two lateral flanges 5*a* of main member 5. Even more particularly, the two ends of secondary axis 14 are located respectively salient from the two lateral flanges 5*a* of main member 5. In other words, the two ends of secondary axis 14 are located outside the inner space. Furthermore, each hearing 25, 26 is located between a shoulder of a flange of main member 5 and movable secondary member 7. In other words, hearings 25, 26 are located outside the holes of the flanges 5*a*. In addition, stops 32, 37 are respectively mounted removable at the two ends of secondary axis 14.

A method is also provided for checking device 1 for supporting and guiding as defined in the foregoing. The method for checking enables the inspection of axes 12 to 19 of device 1. The method comprises checking of an inner wall 23 of an axis 12 to 19. By means of an opening 20 formed inside an axis 12 to 19, access can be had to inner surface 23 of axis 12 to 19. The state of wear of axis 12 to 19 can in this way be easily checked. It is possible to detect whether axis 12 to 19 is cracked and liable to break. Inspection can be performed visually by an operator or by means of measuring apparatus that can be easily inserted into opening 20 formed in this way. For example, the measuring apparatus can be a miniature camera mounted on one end of a flexible rod. Advantageously, checking of the inner wall 23 of an axis 12 to 19 can be performed when hauling cable 2 is pressing on device 1 for supporting and guiding. It is therefore not necessary to disassemble sheave assembly 1 from the tower to inspect axes 12 to 19.

By means of the invention that has been described in the foregoing, a simple means is provided for observing the condition of a device for supporting and guiding. Furthermore, observation can be performed during normal operation of the transportation installation without necessarily dismantling the device for supporting and guiding.

The invention claimed is:

1. A device for supporting and guiding a hauling cable of a vehicle transportation installation, comprising a support structure, a first movable member, a second movable member, and an axis fixed on the first movable member and the second movable member being mounted to swivel with respect to the support structure and to the first movable member, the axis having a body extending along a longitudinal direction, the first movable member comprising two lateral flanges forming an inner space for the second movable member to pass through, two ends of the axis being located respectively salient from the two lateral flanges and outside the inner space, an opening being formed inside the axis and extending between the two ends of the axis, the opening being a through opening, and at least one stop located facing the opening and configured to limit a translation of the axis in the longitudinal direction, a through hole being formed inside said at least one stop.

2. The device according to claim 1, wherein the at least one stop is mounted in a removable manner on the axis.

3. The device according to claim 1, wherein the at least one stop comprises two stops respectively located at the ends of the axis, the stops being configured to limit a translation of the axis in the longitudinal direction.

4. The device according to claim 3, wherein a through hole is formed inside the at least one stop, the device comprising a rod mechanically connecting the two stops to one another and extending inside the opening.

5. A method for checking a device for supporting and guiding a hauling cable of a vehicle transportation installation, comprising providing a device comprising:

a support structure, at least one first movable member, at least one second movable member, the first movable member comprising two lateral flanges forming an inner space for the second movable member to pass through, at least one axis fixed on the first movable member, the at least one axis enabling said at least one second movable member to swivel with respect to the support structure and to the at least one first movable member, the at least one axis having a body extending along a longitudinal direction, two ends of the at least one axis being located respectively salient from the two lateral flanges and outside the inner space, an opening formed inside said at least one axis and extending between two ends of said at least one axis, the opening being a through opening, and at least one stop located facing the opening and configured to limit a translation of the at least one axis in the longitudinal direction, a through hole being formed inside said at least one stop, and checking an inner surface of said at least one axis delimiting the opening.

6. The method for checking according to claim 5, comprising mounting the at least one stop in a removable manner on said at least one axis, then disassembling said at least one stop before checking the inner surface.

7. The method for checking according to claim claim 5, comprising fixing two stops of the at least one stop at the ends of said at least one axis by a rod extending inside the through opening.

* * * * *